US009963996B2

(12) United States Patent
Eng et al.

(10) Patent No.: US 9,963,996 B2
(45) Date of Patent: May 8, 2018

(54) SHROUD COOLING SYSTEM FOR SHROUDS ADJACENT TO AIRFOILS WITHIN GAS TURBINE ENGINES

(71) Applicant: Siemens Aktiengesellschaft, München (DE)

(72) Inventors: Darryl Eng, Stuart, FL (US); Christopher Rawlings, Hobe Sound, FL (US); Thomas Pechette, Palm Beach Gardens, FL (US); Friedrich T. Rogers, West Palm Beach, FL (US); Jae Y. Um, Winter Garden, FL (US); Ching-Pang Lee, Cincinnati, OH (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 0 days. days.

(21) Appl. No.: 15/327,466

(22) PCT Filed: Aug. 22, 2014

(86) PCT No.: PCT/US2014/052275
§ 371 (c)(1),
(2) Date: Jan. 19, 2017

(87) PCT Pub. No.: WO2016/028310
PCT Pub. Date: Feb. 25, 2016

(65) Prior Publication Data

US 2017/0183978 A1 Jun. 29, 2017

(51) Int. Cl.
*F01D 25/12* (2006.01)
*F01D 9/04* (2006.01)
*F01D 11/08* (2006.01)

(52) U.S. Cl.
CPC ..... *F01D 25/12* (2013.01); *F01D 9/04* (2013.01); *F01D 11/08* (2013.01);
(Continued)

(58) Field of Classification Search
CPC . F01D 25/12; F01D 9/04; F01D 11/08; F05D 2220/32; F05D 2260/201; F05D 2260/22141; F05D 2260/232
See application file for complete search history.

(56) References Cited

U.S. PATENT DOCUMENTS 5,584,651 A 12/1996 Pietraszkiewicz et al.
6,270,311 B1 8/2001 Kuwabara et al.
(Continued)

FOREIGN PATENT DOCUMENTS

EP 0515130 A1 11/1992
EP 0893577 A1 1/1999
(Continued)

OTHER PUBLICATIONS

PCT International Search Report and Written Opinion dated Apr. 29, 2015 corresponding to PCT Application PCT/US2014/052275 filed Aug. 22, 2014. (10 pages).

*Primary Examiner* — Igor Kershteyn
*Assistant Examiner* — Eric Zamora Alvarez

(57) ABSTRACT

A shroud cooling system configured to cool a shroud adjacent to an airfoil within a gas turbine engine is disclosed. The turbine engine shroud may be formed from shroud segments that include a plurality of cooling air supply channels extending through a forward shroud support for impingement of cooling air onto an outer radial surface of the shroud segment with respect to the inner turbine section of the turbine engine. The channels may extend at various angles to increase cooling efficiency. The backside surface may also include various cooling enhancement components configured to assist in directing, dispersing, concentrating, or distributing cooling air impinged thereon from the channels to provide enhanced cooling at the backside surface. The shroud cooling system may be used to slow down the
(Continued)

thermal response by isolating a turbine vane carrier from the cooling fluids while still providing efficient cooling to the shroud.

10 Claims, 11 Drawing Sheets

(52) U.S. Cl.
CPC .... *F05D 2220/32* (2013.01); *F05D 2260/201* (2013.01); *F05D 2260/22141* (2013.01); *F05D 2260/232* (2013.01)

(56) References Cited

U.S. PATENT DOCUMENTS 6,340,285 B1 1/2002 Gonyou et al.
6,398,488 B1 6/2002 Solda et al.
6,508,620 B2 1/2003 Sreekanth et al.
6,666,645 B1 12/2003 Arilla et al.
6,851,924 B2 2/2005 Mazzola et al.
6,942,445 B2 9/2005 Morris et al.
7,147,432 B2 12/2006 Lowe et al.
7,246,993 B2 7/2007 Bolms et al.
7,452,184 B2 11/2008 Durocher et al.
7,553,128 B2 * 6/2009 Abdel-Messeh ..... F01D 5/187 415/116
7,604,453 B2 10/2009 Lee et al.
7,607,885 B2 10/2009 Bosley et al.
7,722,315 B2 5/2010 Lee et al.
7,740,444 B2 6/2010 Lee et al.
7,785,067 B2 8/2010 Lee et al.
7,997,856 B2 8/2011 Khanin et al.
8,123,473 B2 2/2012 Shapiro
8,206,101 B2 6/2012 Schilling et al.
8,246,297 B2 8/2012 Jain et al.
8,480,353 B2 7/2013 Koyabu et al.
8,585,354 B1 11/2013 Liang
8,596,962 B1 12/2013 Liang
8,596,963 B1 12/2013 Liang
8,608,443 B2 12/2013 Lee et al.
8,684,662 B2 4/2014 Jiang et al.
8,727,704 B2 5/2014 Lee et al.
2004/0062636 A1 4/2004 Mazzola et al.
2007/0258814 A1 11/2007 Metrisin et al.
2008/0131264 A1 6/2008 Lee et al.
2011/0044805 A1 2/2011 Koyabu et al.
2011/0223005 A1 9/2011 Lee et al.
2011/0305582 A1 12/2011 Lee et al.
2011/0305583 A1 12/2011 Lee et al.
2012/0057968 A1 3/2012 Berrong et al.
2012/0057969 A1 3/2012 Jiang et al.
2012/0067960 A1 3/2012 Lumidigm
2012/0183405 A1 7/2012 Rawlings et al.
2013/0064667 A1 3/2013 Campbell et al.
2013/0108419 A1 5/2013 Brunelli et al.

FOREIGN PATENT DOCUMENTS

FR 2857406 A1 1/2005
GB 2125111 A1 2/1984
WO 9412775 A1 6/1994

* cited by examiner

SHROUD COOLING SYSTEM FOR SHROUDS ADJACENT TO AIRFOILS WITHIN GAS TURBINE ENGINES

FIELD OF THE INVENTION

This invention relates generally to gas turbine engines, and more particularly to cooling systems within shrouds adjacent to airfoils in gas turbine engines.

BACKGROUND

Turbine engines commonly operate at efficiencies less than the theoretical maximum because, among other things, losses occur in the flow path as hot compressed gas travels down the length of the turbine engine. One example of a flow path loss is the leakage of hot combustion gases across the tips of the turbine blades where work is not exerted on the turbine blade. This leakage occurs across a space between the tips of the rotating turbine blades and the surrounding stationary structure, such as ring segments that form a ring seal. This spacing is often referred to as the blade tip clearance.

Blade tip clearances cannot be eliminated because, during transient conditions such as during engine startup or part load operation, the rotating parts (blades, rotor, and discs) and stationary parts (outer casing, blade rings, and ring segments) thermally expand at different rates. As a result, blade tip clearances can actually decrease during engine startup until steady state operation is achieved at which point the clearances can increase, thereby reducing the efficiency of the engine.

In a conventional turbine ring segment assembly, the ring segment receives the cooling air through holes in the turbine vane carrier. These holes provide impingement cooling directly on the backside of the ring segment. Because the cooling air is passing through the turbine vane carrier, the turbine vane carrier thermally responds to the cooling air temperature, which results in undesirably large blade tip clearances. Thus, a need exists to reduce this undesirably large blade tip clearance.

SUMMARY OF THE INVENTION

A shroud cooling system configured to cool a shroud adjacent to an airfoil within a gas turbine engine is disclosed. The turbine engine shroud may be formed from shroud segments that include a plurality of cooling air supply channels extending through a forward shroud support for impingement of cooling air onto an outer radial surface of the shroud segment with respect to the inner turbine section of the turbine engine. The channels may extend at various angles to increase cooling efficiency. The backside surface may also include various cooling enhancement components configured to assist in directing, dispersing, concentrating, or distributing cooling air impinged thereon from the channels to provide enhanced cooling at the backside surface. The shroud cooling system may be used to slow down the thermal response by isolating a turbine vane carrier from the cooling fluids while still providing efficient cooling to the shroud.

In at least one embodiment, the turbine engine may include a rotor assembly having one or more circumferentially aligned rows of turbine blades extending radially outward therefrom. One or more shrouds may be positioned radially outward from the circumferentially aligned row of turbine blades and may have a circumferentially extending shroud body and a radially outward facing backside surface. The shroud may include a forward shroud support axially forward of the backside surface and extending radially outward from the shroud body. The forward shroud support may include a plurality of cooling air supply channels that extend through the forward shroud support to direct cooling air onto the backside surface. The backside surface may include one or more row of ribs positioned thereon.

The plurality of cooling air supply channels may each extend axially through the forward shroud support from a forward port to a rear port at a radially inward directed angle to direct cooling air onto a respective impingement portion of the backside surface. The impingement portion may include one or more rows of ribs positioned thereon. The backside surface may include a first row of ribs formed from a first rib and a second row of ribs formed from a second rib whereby the first rib and the second rib together define a chevron. The first and second ribs may be nonparallel, whereby the first rib is oriented to direct cooling air axially away from the rear port of the associated cooling air supply channel in a first circumferentially outward directed angle along the backside surface. The second rib may be oriented to direct cooling air axially away from the rear port of the associated cooling air supply channel in a second circumferentially outward directed angle nonparallel to the first circumferentially outward directed angle along the backside surface. The first rib and the second rib may each include a first end positioned proximal to the rear port and a second end positioned distal to the first end relative to the rear port. The first end of the first rib and the first end of the second rib may define a gap extending therebetween and axially from the rear port along the impingement portion. One or more cooling air supply channels may extend circumferentially at an outward directed angle toward the first rib and away from the second rib.

The plurality of cooling air supply channels may include a first outer air supply channel, a second outer air supply channel, and an inner air supply channel positioned between the first and second outer air supply channels. Each of the first and second outer air supply channels may be positioned at a nonparallel angle extending outwardly in a circumferential direction relative to the inner air supply channel. In at least one embodiment, two rows of ribs may be positioned on each impingement portion, whereby the first row may be formed from a first rib and the second row may be formed from a second rib. The first rib may extend in a first circumferentially outward direction and the second rib may extend in a second circumferentially outward direction with respect to the rear port of the associated cooling air supply channel.

The first outer air supply channel may be substantially aligned with the first rib positioned on the associated impingement portion in the first circumferentially outward direction, and the second outer air supply channel may be substantially aligned with the second rib positioned on the associated impingement portion in the second circumferentially outward direction. The shroud may include a plurality of circumferentially aligned shroud segments coupled at respective first and second lateral ends. The first rib positioned on the impingement portion associated with the first outer air supply channel may be oriented to direct cooling air from the rear port of the first outer air supply channel toward the first lateral end, and the second rib positioned on the impingement portion associated with the second outer cooling air supply channel may be oriented to direct cooling air from the rear port of the second outer air supply channel toward the second lateral end. A first outer row of ribs may be positioned on the impingement portion associated with the first outer cooling supply channel, and a second outer row of ribs may be positioned on the impingement portion associated with the second outer cooling supply channel. The first outer row of ribs may be oriented to direct cooling air in a first circumferentially outward direction toward the first lateral end, and the second outer row of ribs may be oriented to direct cooling air in a second circumferentially outward direction toward the second lateral end.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
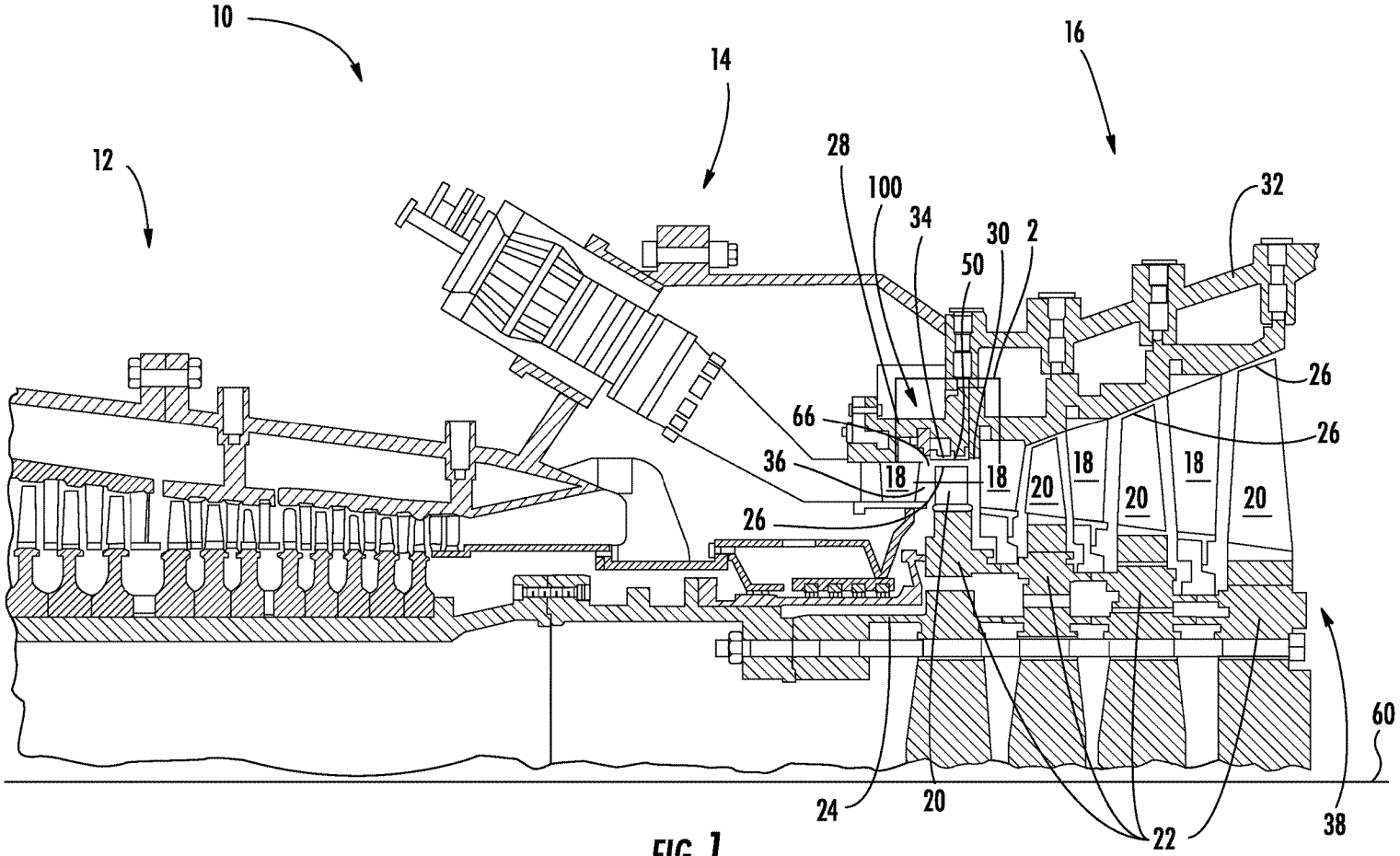
FIG. 1 is a cross-sectional view of a turbine engine with a shroud cooling system.

As shown in FIGS. 1-12, a shroud cooling system 100 configured to cool the shroud 50 adjacent to an airfoil 20 within a gas turbine engine 10 is disclosed. The turbine engine shroud 50 may be formed from shroud segments 34 that include a plurality of cooling air supply channels 40 extending through a forward shroud support 52 for impingement of cooling air onto an outer radial surface 62, commonly called the backside surface 62, of the shroud segment 34 with respect to the inner turbine section 36 of the turbine engine 10. The channels 40 may extend at various angles to increase cooling efficiency. The backside surface 62 may also include various cooling enhancement components 110 configured to assist in directing, dispersing, concentrating, or distributing cooling air impinged thereon from the channels 40 to provide enhanced cooling at the backside surface 62. The present embodiments may be used to slow down the thermal response by isolating a turbine vane carrier 28 from the cooling gas, commonly referred to as cooling air, while still providing efficient cooling to the shroud 50. Aspects of the invention will be explained in connection with a segmented shroud 50, which may be commonly referred to as a ring or segmented ring, and thus various features may be explained in connection with a shroud segment 34. Notably, the disclosed features may be used in other shroud 50 configurations.

As shown in FIG. 1, the turbine engine 10 may include a compressor 12, a combustor 14, and a turbine section 16 with alternating rows of stationary airfoils 18, commonly referred to as vanes 18, and rotating airfoils 20, commonly referred to as blades 20. Each row of blades 20 may be formed by a plurality of airfoils 20 attached to a disc 22 provided on a rotor 24 to form a rotor assembly 38. The blades 20 may extend radially outward from the discs 22 and terminate in a region known as the blade tip 26. Each row of vanes 18 may be formed by attaching one or more vanes 18 to a turbine engine support structure, such as, but not limited to, a turbine vane carrier 28, which may also be referred to as a turbine shroud support (hooks), ring segment support (hooks) and blade outer air seal support (hooks). The vanes 18 may extend radially inward from an inner peripheral surface 30 of the turbine vane carrier 28 and terminate proximate to the rotor 24. The turbine vane carrier 28 may be attached to an outer casing 32, which may enclose the turbine section 16 of the engine 10.

Figure 2:
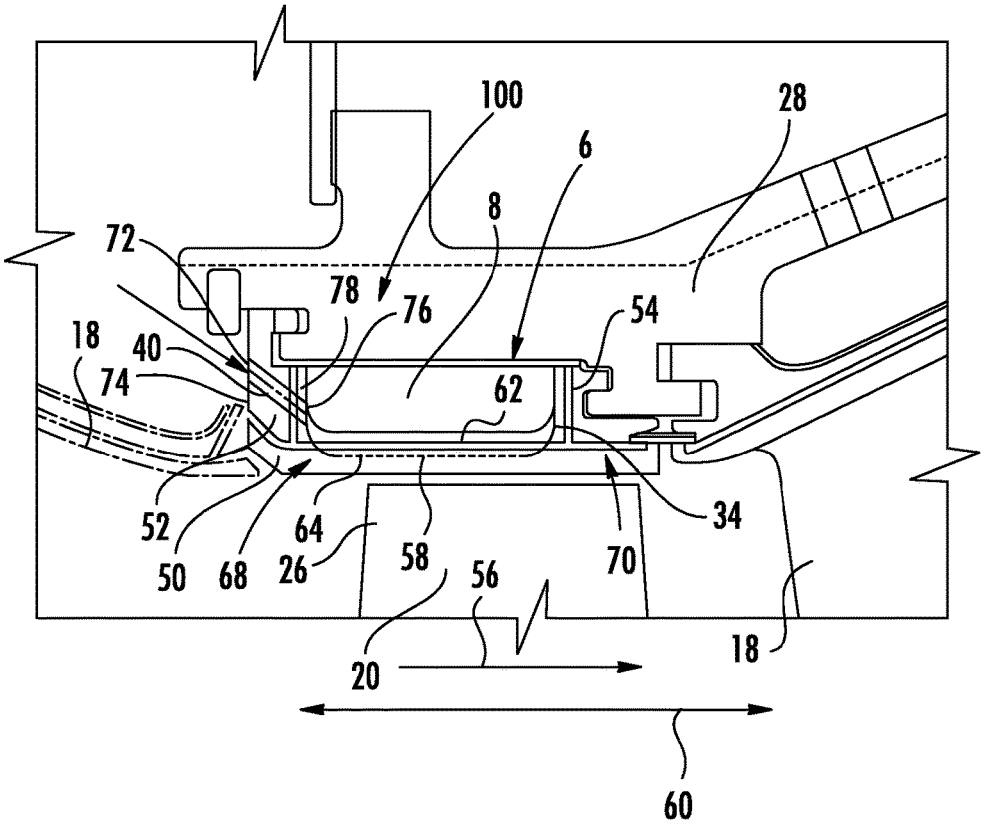
FIG. 2 is a detail view of the shroud cooling system positioned in the turbine engine of FIG. 1.

As shown in FIG. 2, a shroud 50 may be connected to the turbine vane carrier 28 between the rows of vanes 18. The shroud 50 may be a stationary component that acts as a hot gas path guide positioned radially outward from the rotating blades 20. The shroud 50 may be formed by a plurality of circumferentially aligned shroud segments 34. The shroud segments 34 may be attached either directly to the turbine vane carrier 28 or indirectly such as by being attached to metal isolation rings (not shown) that attach to the turbine vane carrier 28. Support for the shroud 50 may include forward and rear shroud supports 52, 54 configured for connecting the shroud 50 and turbine vane carrier 28. Each shroud segment 34 may include a shroud body 58 having a backside surface 62 positioned radially outward and an inner radial surface 64 positioned to substantially surround a row of blades 20 when installed such that the tips 26 of the rotating blades 20 are in close proximity to the shroud body 58. The forward shroud support 52 may extend radially outward from a forward portion 68 of the shroud body 58 along the backside surface 62. The rear shroud support 54 may extend radially from a rear portion 70 of the shroud body 58 along the backside surface 62. The terms "forward" and "rear" are intended to mean relative to the operative direction 56 of the gas flow 66 through the turbine section 16 when the shroud segment 34 is installed in its operational position and may be generally oriented in the axial direction 60 with respect to the turbine axis 60 or rotor 24.

As shown in FIG. 2, channels 40 may extend axially from a forward port 72 or inlet defined at a forward face 74 of the forward shroud support 52 to rear port 76 or outlet defined at the rear face 78 of the forward shroud support 52 and open into a cavity 8 defined by the shroud body 58 and the turbine vane carrier 28. This is in contrast to conventional designs wherein channels are instead located in the turbine vane carrier 28. A heat shield 6 may also be positioned between interfacing portions of the turbine vane carrier 28 and shroud 50. As shown, the heat shield 6 may be positioned between the turbine vane carrier 28 and portions of the forward and rear shroud supports 52, 54 and extend therebetween across the intervening cavity 8 between the backside surface 62 and the turbine vane carrier 28. In at least one embodiment, channels 40 may be provided in the turbine vane carrier 28 as well as the forward shroud support 52 with or without a heat shield 6. The channels 40 may extend through the forward shroud support 52 at various angles to target an impingement portion 80 of the backside surface 62. For example, as shown in FIG. 2, the channels 40 may axially extend through the forward shroud support 52 at a radially inward directed angle 42 with respect to the shroud body 58 or turbine axis 60. The channel 40 may be nonparallel and nonorthogonal to the backside surface 62.

As shown in FIGS. 3-12, numerous embodiments of the shroud cooling system 100 may be positioned in shroud segments 34 that may be, for example, annular segments of a shroud 50 that when combined with additional shroud segments 34 form the shroud 50, e.g., as shown in FIGS. 1 and 2. As described above, the shroud segment 34 may be positioned radially outward from the circumferentially aligned row of turbine blades 20 and may include a circumferentially extending shroud body 58 having a first lateral end 82 and a second lateral end 84. The term "circumferential" is intended to mean circumferential about the turbine axis 60 when the shroud segment 34 is installed to form the shroud 50 in its operational position. The shroud segment 34 may be curved circumferentially as it extends from the first lateral end 82 to the second lateral end 84. In such case, a plurality of the shroud segments 34 may include interfaces 86, 88 at each lateral end 82, 84 and be installed such that the interface 86, 88 at each of the lateral ends 82, 84 of a shroud segment 34 contacts or is adjacent to an interface 86, 88 at one of the lateral ends 82, 84 of an adjacent shroud segment 34 so as to collectively form an annular arranged shroud 50. The shroud segment 34 may include a forward shroud support 52 extending radially from the shroud body 58 with respect to the turbine axis 60 from an axially forward portion 68 of the shroud body 58 along the backside surface 62. A rear shroud support 54 may extend from the shroud body 58 from an axially rear portion 70 of the shroud body 58 along the backside surface 62.

Figure 3:
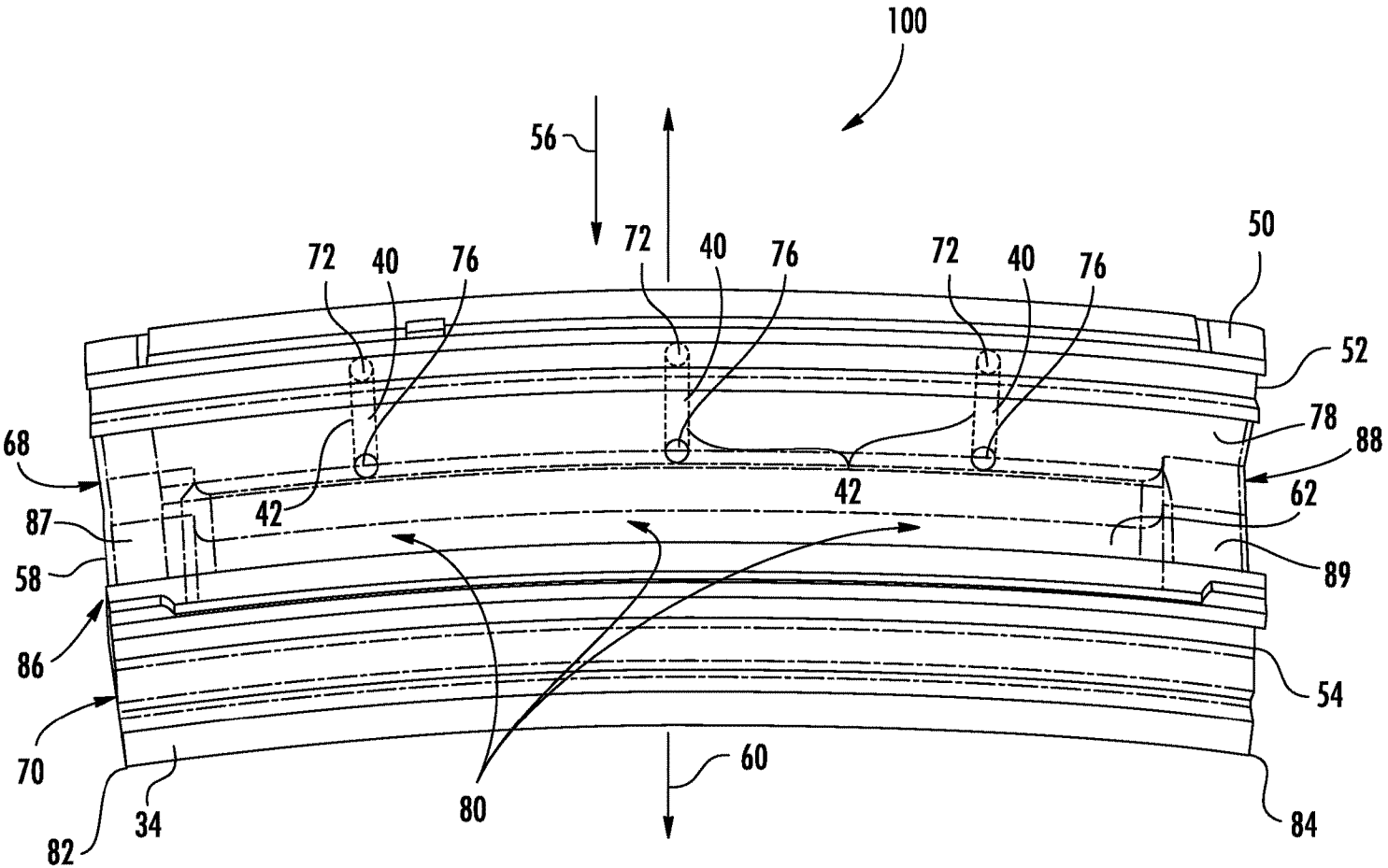
FIG. 3 is a perspective view of an embodiment of the shroud cooling system.
Figure 4:
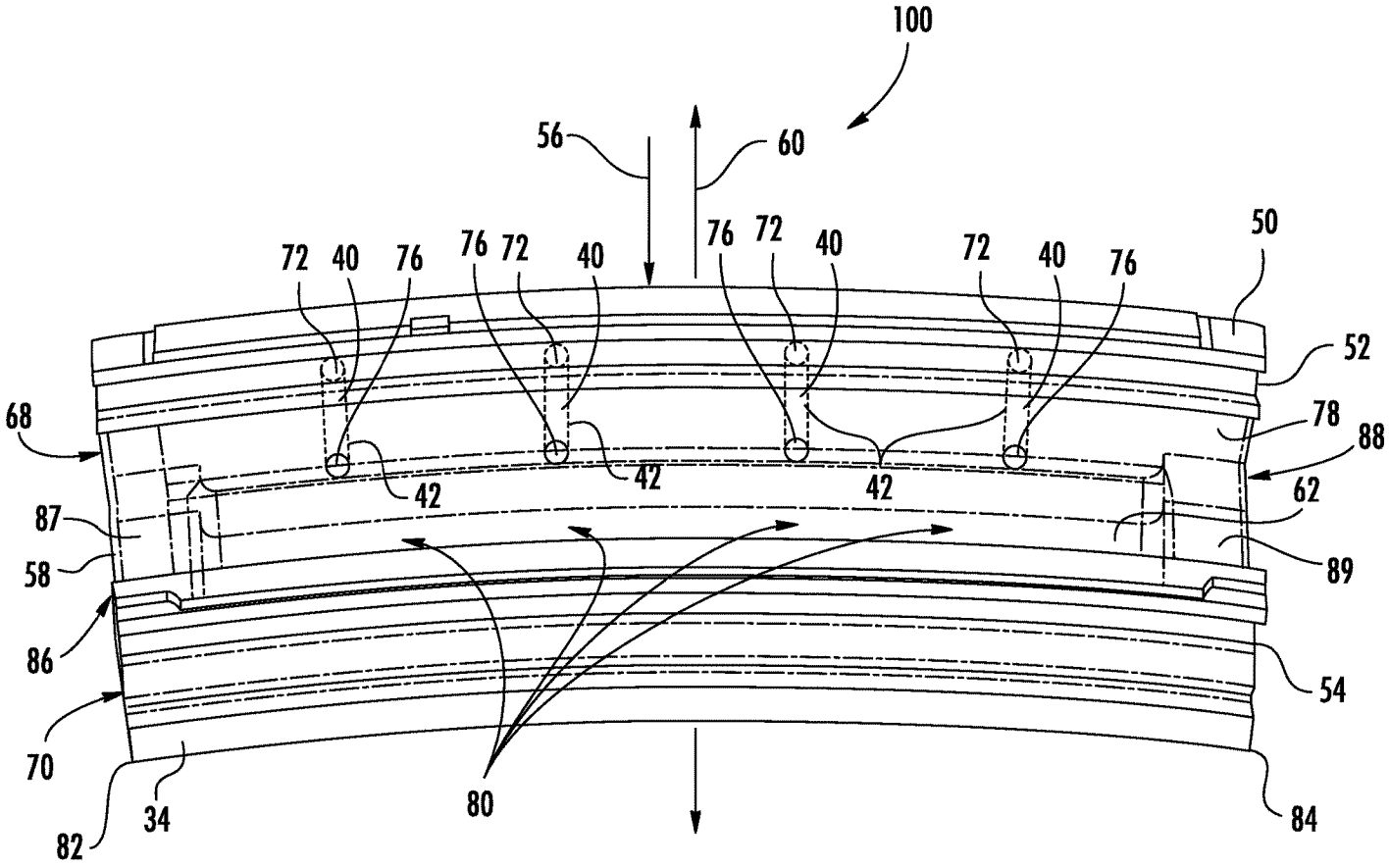
FIG. 4 is a perspective view of an embodiment of the shroud cooling system.

As described above with respect to FIGS. 1 and 2, the cooling air supply channels 40 may extend axially from the forward port 72 at the forward face, which is not visible from the perspectives shown in FIGS. 3-6 and 9-12, of the forward shroud support 52 to the rear port 76 at the rear face 78 of the forward shroud support 52 to open into the cavity 8. FIG. 3 shows a shroud configuration having three channels 40, and FIG. 4 shows a variation of the configuration of FIG. 3 with four channels 40. According to various aspects, the number and size of channels 40 may be varied, for example, to address design considerations such as the dimensions of the channels 40, ports 72, 76, or shroud 50 or the material composition of the components. In at least one embodiment, a configuration having four channels 40, as shown in FIG. 4, may increase cooling efficiency or uniformity compared to a configuration having three channels 40, as shown in FIG. 3.

The cooling air supply channels 40 may extend through the forward shroud support 52 at various angles that are nonparallel and nonorthogonal to the backside surface 62 to target the backside surface 62 for impingement of cooling air at the backside surface 62 of the shroud 50. Each channel 40 may be configured to direct a stream of cooling air onto an associated impingement portion 80 or region of the backside surface 62. For example, each channel 40 may be configured to direct a stream of cooling air onto an impingement portion 80 located proximate to the rear port 76 of the channel 40. The channel 40 or rear port 76 may be dimensioned to concentrate or focus impingement upon a target of the impingement portion 80 to produce a desired flow pattern of cooling air. For example, the target may be positioned such that the impinged gas may interact with a cooling enhancement component 110 positioned on the backside surface 62, as described in more detail below, and be thereby directed along the backside surface 62 to obtain more efficient or fuller cooling. In at least one embodiment, as shown in FIGS. 2-12, the rear ports 76 may be positioned at or near a transition between the rear face 78 of the forward support 52 and the backside surface 62 to direct cooling air axially along the impingement portion 80 of the backside surface 62 from an axially forward portion of the backside surface 62, proximal to the rear port 76, toward an axially rear portion 70 of the backside surface 62, distal of the rear port 76. In various embodiments, the channels 40 may be arranged along the forward shroud support 52 laterally between the first and second lateral ends 82, 84 or radially, e.g., stacked, and may be spaced apart at substantially equivalent or different intervals. The channels 40 may extend at the same or different angles and the respective forward and rear ports 72, 76 may be laterally or radially aligned or offset along the forward or rear face 74, 78 of the forward shroud support 52. As shown in FIGS. 3 and 4, channels 40 may extend axially through the forward shroud support 52 between a forward port 72 and a rear port 76 at a radially inward directed angle 42 relative to the backside surface 62 to direct cooling air onto a respective impingement portion 80 of the backside surface 62.

Figure 5:
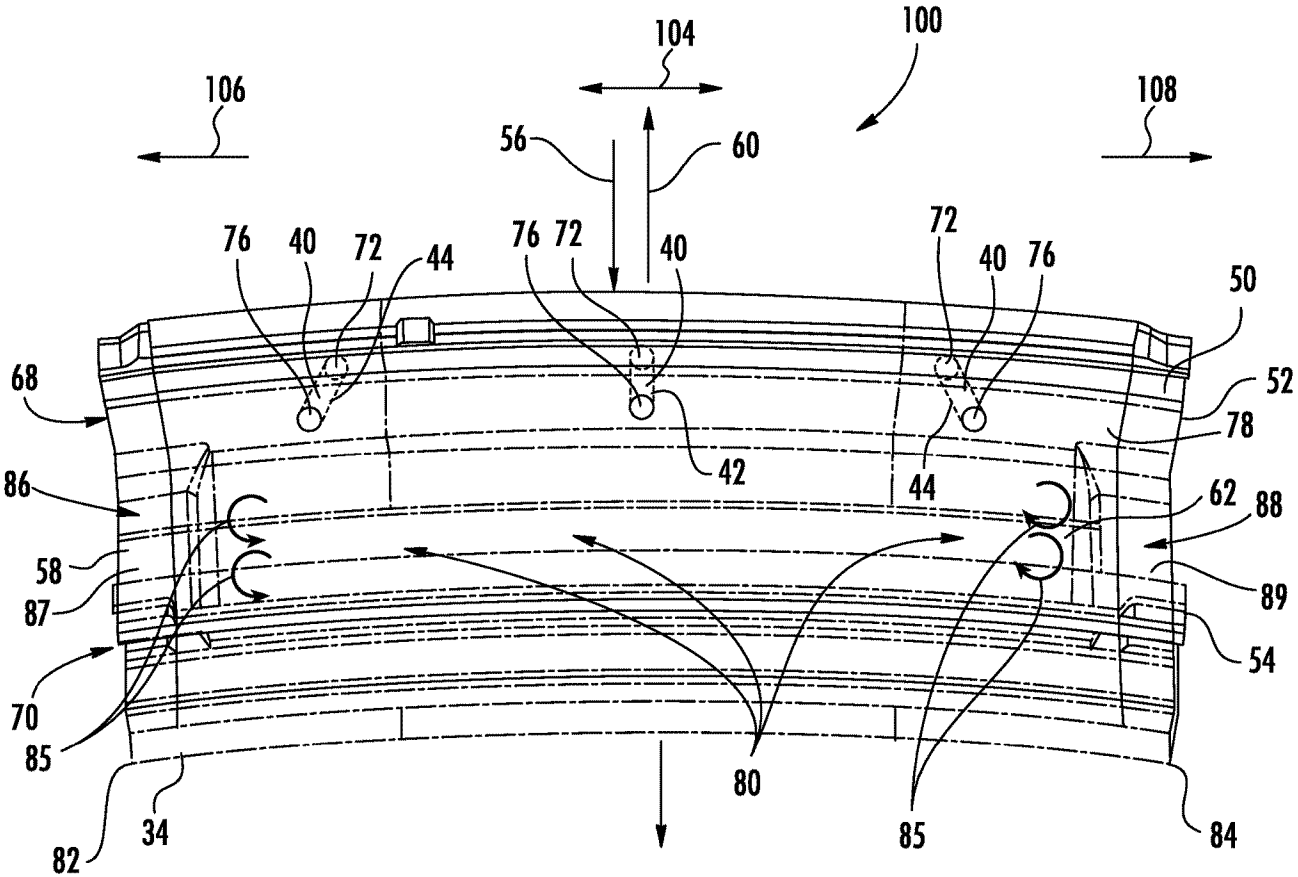
FIG. 5 is a perspective view of an embodiment of the shroud cooling system.
Figure 6:
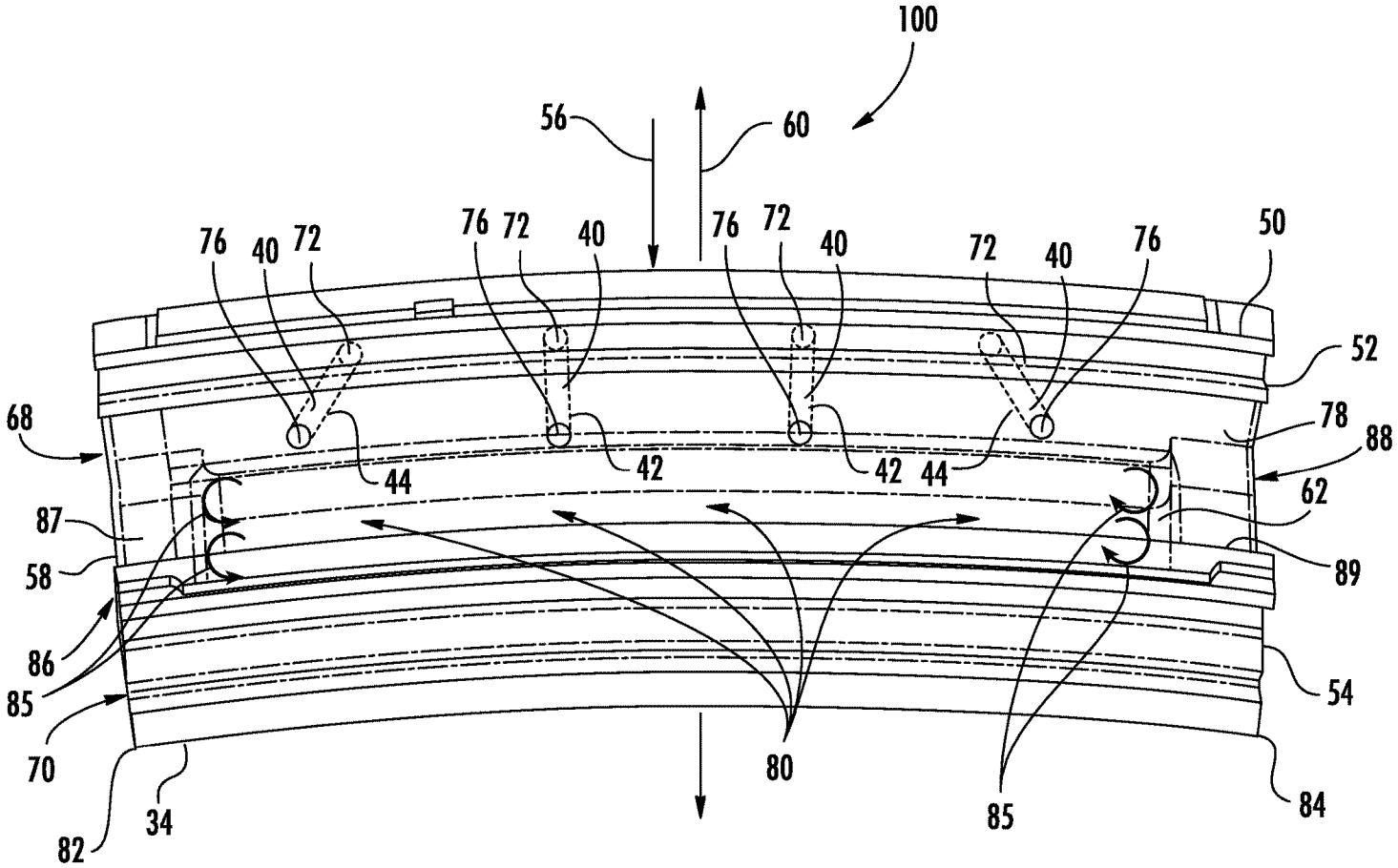
FIG. 6 is a perspective view of an embodiment of the shroud cooling system.

As shown in FIGS. 5 and 6 show shroud segments 34 may have three and four cooling air supply channel 40 configurations including outer positioned channels 40 configured to direct cooling air toward the lateral ends 82, 84 of the shroud segments 34 and inner channels 40 positioned between the outer channels 40 wherein the outer channels are positioned circumferentially outward. The outer and inner channels 40 may extend at a radially inward angle 42, similar to the channels shown in FIGS. 3 and 4. However, in at least one embodiment, the outer or inner channels 40 may not extend at a radially inward angle 42. As shown in FIGS. 5-6, the outer channels 40 may be directed at a nonparallel angle, circumferentially outwardly in a circumferential direction relative to an inner channel 40. For example, the channels 40 may include a first outer channel 40 positioned adjacent the first lateral end 82 and a second outer channel 40 posited adjacent the second lateral end 84. The first outer channel 40 may extend at an angle outward in a first circumferential direction 106 relative to an inner channel 40 positioned between the first and second outer channels 40. The second outer air supply channel 40 may extend at a second angle outward in a second circumferential direction 108 relative to the inner channel 40. In at least one embodiment, the first angle may be nonparallel to the second angle. When the shroud 50 may include a plurality of the shroud segments 34 positionable such that the lateral ends 82, 84 of the shroud segments 34 may be circumferentially aligned along their interfaces 86, 88 to collectively form an annular arranged shroud 50, the outer channels 40 may be positioned at a circumferentially outward angle to direct cooling air toward the respective first and second lateral ends 82, 84. For example, in at least one embodiment, the outer channels 40 may be directed circumferentially outward to direct cooling air toward the lateral ends 82, 84 to improve cooling adjacent to the interfaces 86, 88 or mate-faces, which may include raised surfaces 87, 89. The lateral ends 82, 84 may include raised surfaces 87, 89 and the rear ports 76 may be positioned at or near the base of the forward shroud support 52 or at a radial height outward, aligned with or inward of the raised surface 87, 89.

Figure 8:
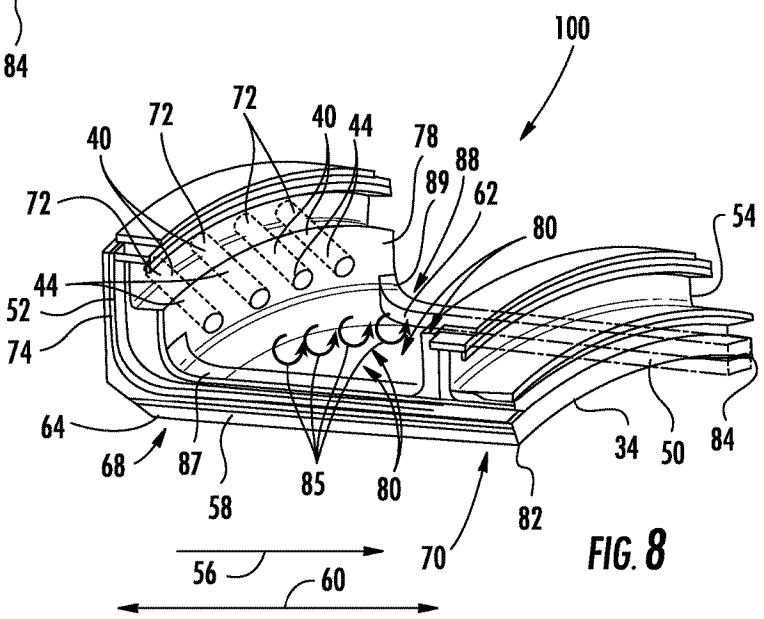
FIG. 8 is a perspective view of an embodiment of the shroud cooling system.
Figure 7:
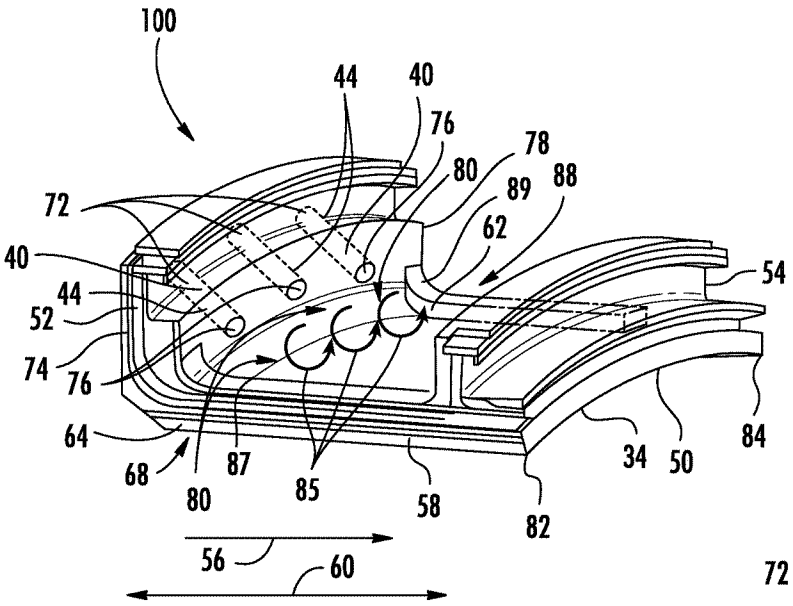
FIG. 7 is a perspective view of an embodiment of the shroud cooling system.

One or more of the channels 40 positioned at a circumferentially outward angle may extend axially through the forward shroud support 52 at a compound angle 44 having a radially inward angle component and a circumferentially outward angle component. Channels 40 directed at such compound angles 44, such as the outer channels shown in FIGS. 5 and 6, may be configured to produce compound impingement to form vortices 85 adjacent to the interfaces 86, 88 for improved heat transfer. FIGS. 7 and 8 show additional embodiments of the shroud segment 34 in which three or more sequentially positioned channels 40 extend at compound angles 44 to produce a one-dimensional swirl impingement. As shown in FIG. 7, the shroud cooling system 100 includes a three channel 40 configuration, and, as shown in FIG. 8, the shroud cooling system 100 includes a four channel 40 configuration, however, as described above, fewer or additional channels 40 may be used in other embodiments. For example, additional channels 40 may produce additional or better developed vortices 85 along the backside surface 62. The channels 40 may also extend at the same or substantially the same compound angle 44. For example, the three or more sequential channels 40 may all extend axially through the forward shroud support 52 at the same radially inward and circumferentially outward angle to direct cooling air at the compound angle 44. While the circumferentially outward component of the compound angles 44 of FIGS. 7 and 8 may be directed toward the second lateral end 84 of the shroud segments 34, in at least one embodiment, the circumferentially outward component of the compound angles 44 may be directed toward the first lateral end 82 of the shroud segment 34. In addition to producing vortices 85 of impinged air when impinged on the impingement portions 80, similar to the outer channels 40 of FIGS. 5 and 6, sequential channels 40 directed toward respective impingement surfaces 80 at compound angles 44 may be configured to further generate a one-dimensional swirl impingement produced from coherent flow at vortex boundaries or across the associated impingement portions 80, as shown in FIGS. 7 and 8, to increase flow circulation for the cooling of the shroud segment 34.

As introduced above in various embodiments, the backside surface 62 may include various cooling enhancement components 110 configured to assist in directing, dispersing, concentrating, or distributing cooling air impinged upon the impingement portions 80 to provide enhanced cooling along the backside surface 62. Cooling enhancement components 110 may include raised or lowered surfaces or contours such as protrusions or scoring that may be patterned on the backside surface 62. In at least one embodiment, the cooling enhancement components 110 may increase surface area and assist in directing cooling air flow along the backside surface 62. The cooling enhancement components 110 may direct cooling air flow proximally from a rear port 76 of a channel 40 distally in the axial direction, circumferential direction, or both along the backside surface 62.

Figure 9:
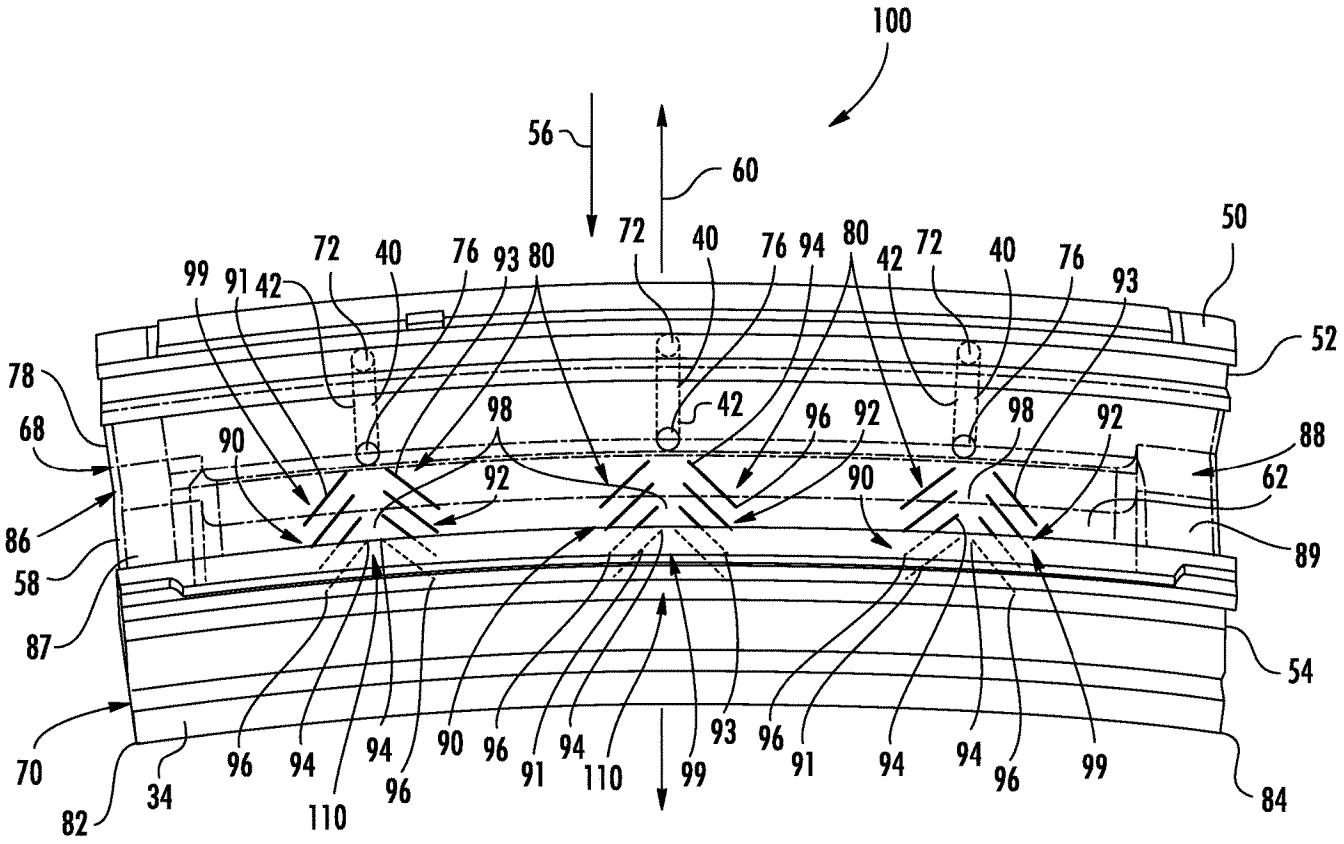
FIG. 9 is a perspective view of an embodiment of the shroud cooling system.
Figure 10:
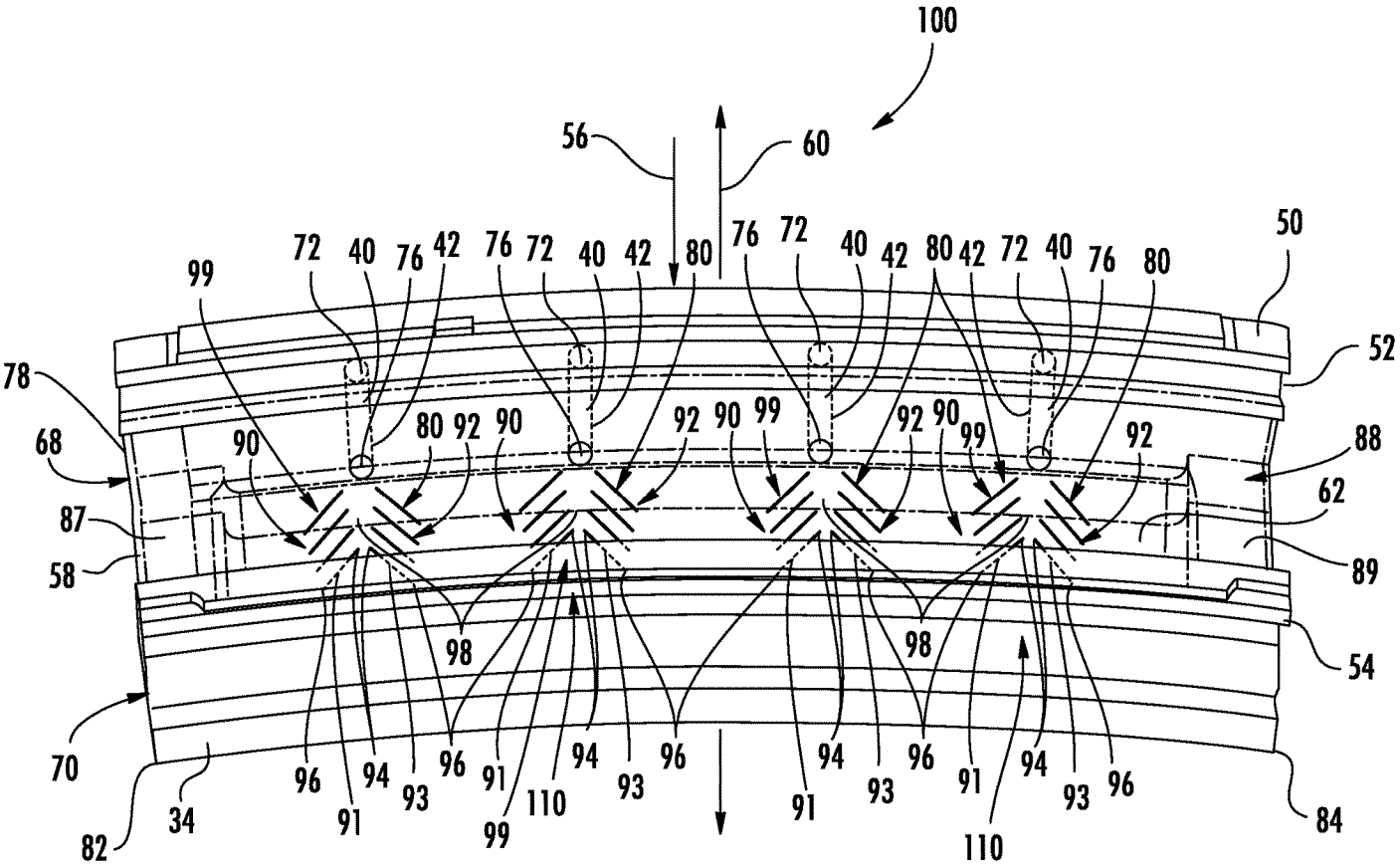
FIG. 10 is a perspective view of an embodiment of the shroud cooling system.

The shroud segments 34 shown in FIGS. 9 and 10 may be similar to the shroud segments 34 shown in FIGS. 3 and 4 and further include cooling enhancement components 110 positioned on the backside surfaces 62. The shroud segments 34 shown in FIGS. 11 and 12 may be similar to the shroud segments 34 shown in FIGS. 5 and 6 and further include cooling enhancement components 110 positioned on the backside surface 62. The cooling enhancement components 110 may be formed as one or more elongate ribs 91, 93 extending radially outward from the backside surface 62. In at least one embodiment, fewer than all the impingement portions 80 associated with the channels 40 include cooling enhancement components 110, e.g., one or more ribs 91, 93. For example, the impingement portions 80 associated with the channels 40 positioned proximate to the lateral ends 82, 84, e.g., outer channels 40, may include ribs 91, 93 while the impingement portions 80 associated with the channels 40 positioned between the outer channels 40, e.g., inner channels 40, may include different cooling enhancement components 110 or none at all. While other arrangements of ribs 91, 93 may be used, FIGS. 9-12 show configurations of sets of ribs 91, 93 arranged in axially aligned rows 90, 92 of ribs 91, 93 extending along the impingement portions 80. The ribs 91, 93 may direct cooling air from a forward portion of the backside surface 62, proximal to the rear port 76, or an impingement target to a rear portion 70 of the backside surface 62, distal to the rear port 76, or away from the impingement target. In at least one embodiment, rear ports 76 may be configured to focus, spray, or otherwise modify the cooling air stream impinged upon the impingement portion 80 to increase coverage or induce desired flow patterns.

While each row of ribs 90, 92 is shown as including four ribs 91, 93, respectively, fewer or additional ribs 91, 93 may be used. In at least one embodiment, the ribs 91, 93 may be positioned along the backside surface 62 in an offset pattern such that a row of ribs 90, 92 includes one or more ribs 91, 93 that extend axially or circumferentially beyond another rib 91, 93. The ribs 91, 93 may be angled to direct a portion of impinged cooling air circumferentially outward from the rear port 76 of the associated channel 40. In at least one embodiment, the ribs 91, 93 may be positioned between the rear ports 76 of the channels 40 on the backside surface 62 to direct impinged air between the impingement portions 80 to promote full cooling along the impingement portions 80. In at least one embodiment, the ribs 91, 93 may be positioned to direct and thereby converge impinged air from multiple channels 40 to create overlapping impingement portions 80.

As shown in FIGS. 9-12, multiple rows 90, 92 of ribs 91, 93 may be provided. The ribs 91, 93 may extend from a proximal end 94 to a distal end 96 with respect to the rear port 76 and be positioned at circumferentially outward angles with respect to the rear port 76 to direct impinged air from a central area or impingement target circumferentially outward toward an adjacent impingement portion 80 or interface 86, 88 area. Thus, the ribs 91, 93 may be oriented to distribute impinged air circumferentially along the backside surface 62 to combine with impinged air originating from an adjacent or another channel 40 to create overlapping impingement portions 80 between the rear ports 76. In at least one embodiment, as shown in FIGS. 9-12, impingement portions 80 may include two rows 90, 92 of ribs 91, 93 oriented to form a set of chevron ribs 99. The chevron ribs 99 may be positioned on the impingement portion 80 to enhance heat transfer or improve the heat transfer distribution. The chevron ribs 99 may be positioned on the impingement portions 80 associated with axially extending channels 40 directed at radially inward angles 42, such as the channels 40 shown in FIGS. 9 and 10 and the inner channels 40 shown in FIGS. 11 and 12. The chevron ribs 99 may also be positioned on the impingement portions 80 associated with channels 40 having compound angles 44 configured for compound impingement, similar to the inner channels 40 shown in FIGS. 11 and 12, for further improvement in heat transfer or distribution.

Thus, one or more impingement portions 80 of a backside surface 62 may include a set of chevron ribs 99 having a first row of ribs 90 and a second row of ribs 92. The channels 40 may extend axially through the forward shroud support 52 at a radially inward directed angle 42 to direct cooling air onto respective impingement portions 80 of the backside surface 62. The channels 40 may be angled 42, 44 to direct cooling air onto an impingement target within the impingement portion 80 that may be located along, adjacent to, or just proximal to the proximal ends 94 of one or more of the ribs in a row of ribs 90, 92. A gap 98 may be defined between the proximal ends 94 of the first and second ribs 91, 93 such that a portion of impinged air may flow to and be further directed to more distally positioned ribs 91, 93 with respect to the rear port 76. A first rib 91 may be oriented to direct cooling air axially away from the rear port 76 of the associated channel 40 at a first circumferentially outward directed angle along the backside surface 62. A second rib 93 may be oriented to direct cooling air axially away from the rear port 76 of the associated channel 40 at a second circumferentially outward directed angle along the backside surface 62.

Figure 11:
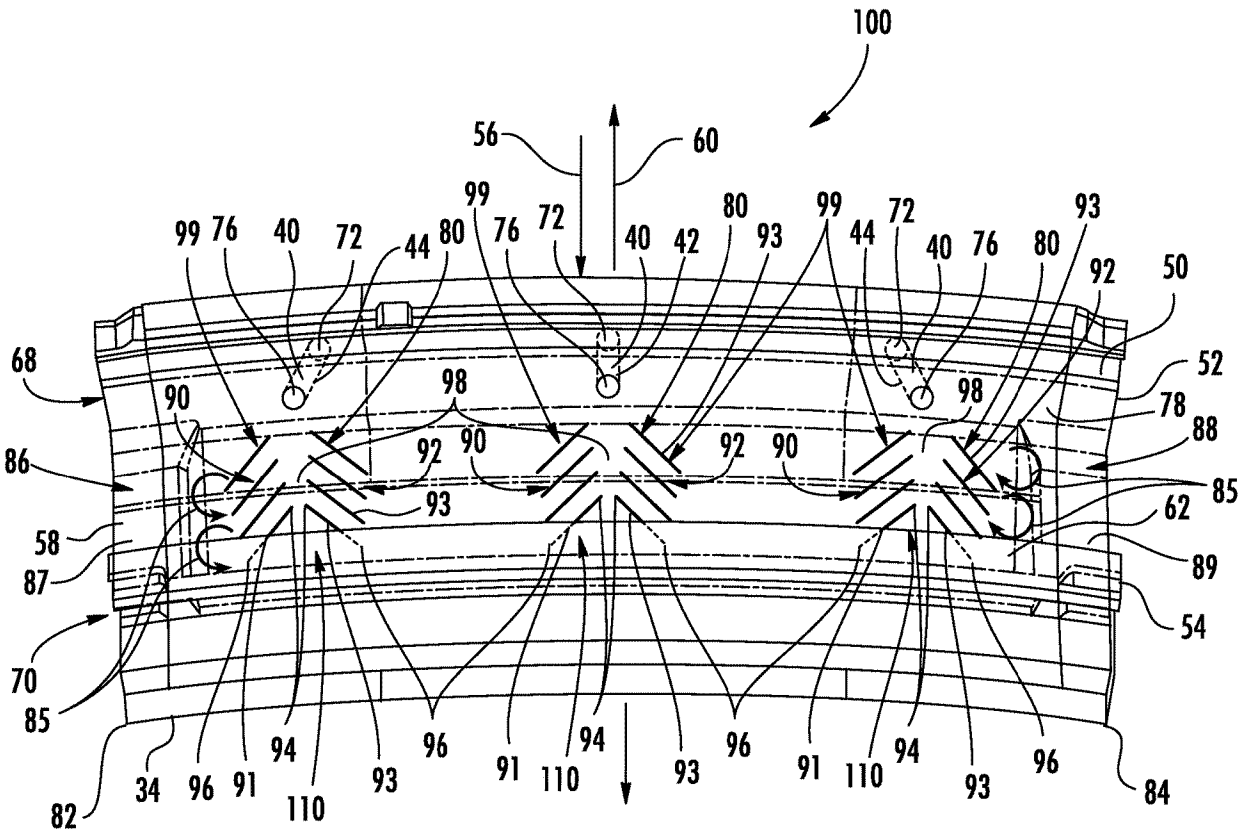
FIG. 11 is a perspective view of an embodiment of the shroud cooling system.
Figure 12:
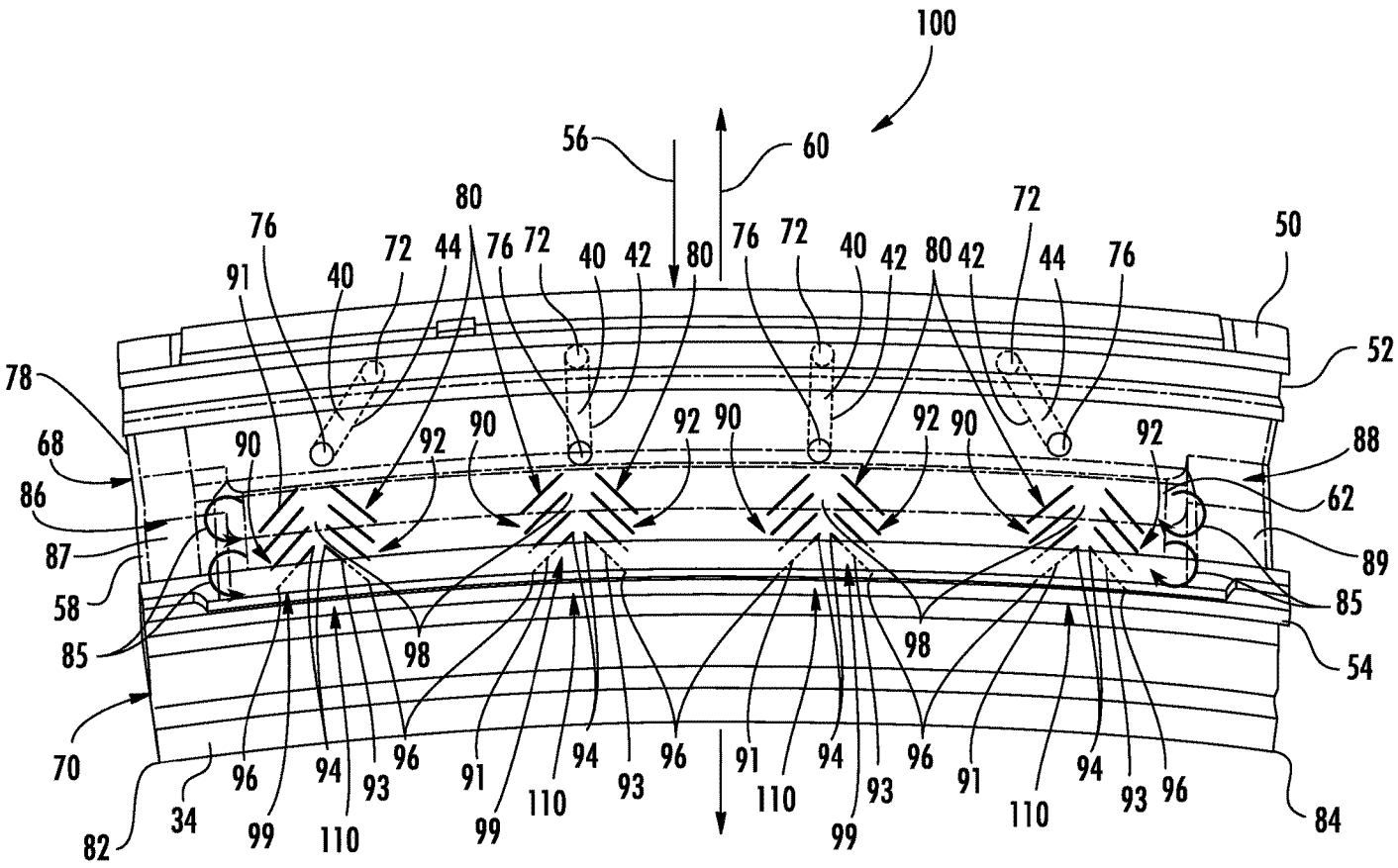
FIG. 12 is a perspective view of an embodiment of the shroud cooling system.

In at least one embodiment, as shown in FIGS. 11 and 12, shroud segments 34 may include cooling air supply channels 40 that extend at compound angles 44, as described above with respect to FIGS. 5-8, and further include cooling enhancement components 110 protruding from the backside surface 62 to enhance heat transfer or distribution. The compound angle 44 channels 40 may therefore extend at a circumferentially outward directed angle toward one of the ribs 91, 93 or rows 90, 92 of ribs 91, 93 and away from the other rib 91, 93 or row of ribs 92. In at least one embodiment, the circumferentially outward portion of the compound angle 44 of the channel 40 is the same or similar as the circumferentially outward portion of the angle of the rib 91, 93 in which it is directed. In at least one embodiment, when a channel 40 extends at compound angles 44 and is directed toward a particular rib 91, 93 or row of ribs 90, 92 within the associated impingement portion 80, as in FIGS. 11 and 12, the impingement portion 80 associated with the compound angle 44 channel 40 may not include multiple ribs 91, 93 or multiple rows 90, 92 of ribs 91, 93. In one such embodiment, the channels 40 that do not extend at a compound angle 44 may include both first and second rows 90, 92 of ribs 91, 93. In at least one embodiment wherein the channels 40 are directed at compound angles 44, as shown in FIGS. 7 and 8, the backside surface 62 may include one or more rows 90, 92 of ribs 91, 93, which may include a set of chevron ribs 99, extending within the impingement portion 80 associated with one or all of the channels 40 to enhance heat transfer.

The foregoing is provided for purposes of illustrating, explaining, and describing embodiments of this invention. Modifications and adaptations to these embodiments will be apparent to those skilled in the art and may be made without departing from the scope or spirit of this invention.

What is claimed is:

1. A turbine engine comprising:

a rotor assembly having at least one circumferentially aligned row of turbine blades extending radially outward therefrom;

at least one shroud positioned radially outward from the circumferentially aligned row of turbine blades and having a circumferentially extending shroud body and a radially outward facing backside surface, wherein the shroud includes a forward shroud support axially forward of the backside surface and extending radially outward from the shroud body;

wherein the forward shroud support includes a plurality of cooling air supply channels that extend through the forward shroud support to direct cooling air onto the backside surface; and wherein the backside surface includes at least one row of ribs positioned thereon, wherein the plurality of cooling air supply channels comprise a first outer air supply channel, a second outer air supply channel, and an inner air supply channel positioned between the first and second outer air supply channels, and wherein each of the first and second outer air supply channels is positioned at a nonparallel angle extending outwardly in a circumferential direction relative to the inner air supply channel.

2. The turbine engine of claim 1, wherein the plurality of cooling air supply channels each extend axially through the forward shroud support from a forward port to a rear port at a radially inward directed angle to direct cooling air onto a respective impingement portion of the backside surface, and wherein at least one impingement portion includes one or more rows of ribs positioned thereon.

3. The turbine engine of claim 2, wherein the backside surface includes a first row of ribs comprising a first rib and a second row of ribs comprising a second rib, wherein the first rib and the second rib together define a chevron, wherein the first and second ribs are nonparallel, wherein the first rib is oriented to direct cooling air axially away from the rear port of the associated cooling air supply channel in a first circumferentially outward directed angle along the backside surface, and wherein the second rib is oriented to direct cooling air axially away from the rear port of the associated cooling air supply channel in a second circumferentially outward directed angle nonparallel to the first circumferentially outward directed angle along the backside surface.

4. The turbine engine of claim 3, wherein the first rib and the second rib each comprise a first end positioned proximal to the rear port and a second end positioned distal to the first end relative to the rear port, and wherein the first end of the first rib and the first end of the second rib define a gap extending therebetween and axially from the rear port along the impingement portion.

5. The turbine engine of claim 3, wherein at least one of the cooling air supply channels extends circumferentially at an outward directed angle toward the first rib and away from the second rib.

6. The turbine engine of claim 1, wherein two rows of ribs are positioned on each impingement portion, wherein the first row comprises a first rib and the second row comprises a second rib, and wherein the first rib extends in a first circumferentially outward direction and the second rib extends in a second circumferentially outward direction with respect to a rear port of the associated cooling air supply channel.

7. The turbine engine of claim 6, wherein the first outer air supply channel is substantially aligned with the first rib positioned on the associated impingement portion in the first circumferentially outward direction and the second outer air supply channel is substantially aligned with the second rib positioned on the associated impingement portion in the second circumferentially outward direction.

8. The turbine engine of claim 6, wherein the shroud comprises a plurality of circumferentially aligned shroud segments coupled at respective first and second lateral ends, wherein the first rib positioned on the impingement portion associated with the first outer air supply channel is oriented to direct cooling air from the rear port of the first outer air supply channel toward the first lateral end, and wherein the second rib positioned on the impingement portion associated with the second outer cooling air supply channel is oriented to direct cooling air from the rear port of the second outer air supply channel toward the second lateral end.

9. The turbine engine of claim 1, wherein a first outer row of ribs is positioned on the impingement portion associated with the first outer cooling supply channel and a second outer row of ribs is positioned on the impingement portion associated with the second outer cooling supply channel, wherein the first outer row of ribs is oriented to direct cooling air in a first circumferentially outward direction toward the first lateral end and the second outer row of ribs is oriented to direct cooling air in a second circumferentially outward direction toward the second lateral end.

10. A turbine engine comprising:

a rotor assembly having at least one circumferentially aligned row of turbine blades extending radially outward therefrom;

at least one shroud positioned radially outward from the circumferentially aligned row of turbine blades and having a circumferentially extending shroud body and a radially outward facing backside surface, wherein the shroud includes a forward shroud support axially forward of the backside surface and extending radially outward from the shroud body;

wherein the forward shroud support includes a plurality of cooling air supply channels that extend through the forward shroud support to direct cooling air onto the backside surface; and wherein the backside surface includes at least one row of ribs positioned thereon, wherein the plurality of cooling air supply channels each extend axially through the forward shroud support from a forward port to a rear port at a radially inward directed angle to direct cooling air onto a respective impingement portion of the backside surface, and wherein at least one impingement portion includes one or more rows of ribs positioned thereon, wherein the backside surface includes a first row of ribs comprising a first rib and a second row of ribs comprising a second rib, wherein the first rib and the second rib together define a chevron, wherein the first and second ribs are nonparallel, wherein the first rib is oriented to direct cooling air axially away from the rear port of the associated cooling air supply channel in a first circumferentially outward directed angle along the backside surface, and wherein the second rib is oriented to direct cooling air axially away from the rear port of the associated cooling air supply channel in a second circumferentially outward directed angle nonparallel to the first circumferentially outward directed angle along the backside surface, wherein at least one of the cooling air supply channels extends circumferentially at an outward directed angle toward the first rib and away from the second rib.

* * * * *